US007472891B2

(12) United States Patent
Schram et al.

(10) Patent No.: US 7,472,891 B2
(45) Date of Patent: Jan. 6, 2009

(54) BOLLARD ASSEMBLY

(75) Inventors: Michael D. Schram, 951 Pebble Beach Ct., Geneva, IL (US) 60134; Richard Beames, Burlington, IA (US); Tim Beames, Burlington, IA (US); Lon Newton, West Point, IA (US)

(73) Assignee: Michael D. Schram, Geneva, IL (US)

( * ) Notice: Subject to any disclaimer, the term of this patent is extended or adjusted under 35 U.S.C. 154(b) by 427 days.

(21) Appl. No.: 11/342,899

(22) Filed: Jan. 30, 2006

(65) Prior Publication Data

US 2007/0176159 A1 Aug. 2, 2007

(51) Int. Cl.
*E04H 17/00* (2006.01)

(52) U.S. Cl. ..... 256/65.14; 403/109.7; 403/353

(58) Field of Classification Search ..... 256/65.14; 403/109.7, 109.8, 353; 49/35; 404/6, 9, 404/11

See application file for complete search history.

(56) References Cited

U.S. PATENT DOCUMENTS

| | | | | |
|---|---|---|---|---|
| 3,049,728 | A * | 8/1962 | Lund | 5/99.1 |
| 3,061,960 | A | 11/1962 | Dull | |
| 3,417,508 | A | 12/1968 | Sprung | |
| 3,600,853 | A | 8/1971 | Goldberg | |
| 3,956,853 | A | 5/1976 | Montgomery | |
| 4,003,161 | A * | 1/1977 | Collins | 49/35 |
| 4,561,798 | A | 12/1985 | Elcrin et al. | |
| 4,746,149 | A | 5/1988 | Thompson | |
| 5,018,902 | A | 5/1991 | Miller et al. | |
| 5,192,159 | A | 3/1993 | Higginson | |
| 5,253,716 | A | 10/1993 | Mitchell | |
| 5,441,359 | A | 8/1995 | Filippi | |
| 5,466,020 | A | 11/1995 | Page et al. | |
| 5,487,618 | A | 1/1996 | Cox | |
| 5,597,262 | A | 1/1997 | Beavers et al. | |
| 5,741,084 | A | 4/1998 | Del Rio et al. | |
| 5,895,169 | A | 4/1999 | Holm et al. | |
| 6,065,900 | A | 5/2000 | Reale | |
| 6,398,136 | B1 | 6/2002 | Smith | |
| 6,539,759 | B2 | 4/2003 | Pershall | |
| 6,805,515 | B2 | 10/2004 | Reale | |

FOREIGN PATENT DOCUMENTS

| | | | |
|---|---|---|---|
| AU | 624290 | | 6/1992 |
| GB | 2392699 | A * | 3/2004 |

* cited by examiner

*Primary Examiner*—Victor MacArthur
(74) *Attorney, Agent, or Firm*—Wildman, Harrold, Allen & Dixon LLP

(57) ABSTRACT

A bollard assembly having a post and a sleeve. The post has a cylindrical post wall forming a cavity and a passage in the post wall. The passage has a first section that extends longitudinally along the post wall and a second section that intersects the first section and extends crosswise to the first section. The sleeve has a cylindrical sleeve wall forming a cavity and a latch pin that is attached to the sleeve wall and extends into the cavity. The sleeve is adapted to receive the post such that the latch pin travels through the passage in the post wall.

11 Claims, 8 Drawing Sheets

BOLLARD ASSEMBLY

FIELD OF THE INVENTION

This invention relates generally to bollards. In particular, this invention relates to removable and lockable bollards.

BRIEF SUMMARY

In one example, a bollard assembly having a post and a sleeve is provided. The post has a cylindrical post wall forming a cavity and a passage in the post wall. The passage has a first section that extends longitudinally along the post wall and a second section that intersects the first section and extends crosswise to the first section. The sleeve has a cylindrical sleeve wall forming a cavity and a latch pin that is attached to the sleeve wall and extends into the cavity. The sleeve is adapted to receive the post such that the latch pin travels through the passage in the post wall.

In another example, the post of the bollard assembly also has a lock assembly that has a lock cylinder and a bar. The lock cylinder is secured to the post wall and extends into the cavity formed by the post wall. The bar is connected to the lock cylinder and is disposed within the cavity formed by the post wall such that it prevents the latch pin from traveling through the passage when the lock cylinder is in a first position and allows the latch pin to travel through the passage when the lock cylinder is in a second position.

DETAILED DESCRIPTION

Figure 1:
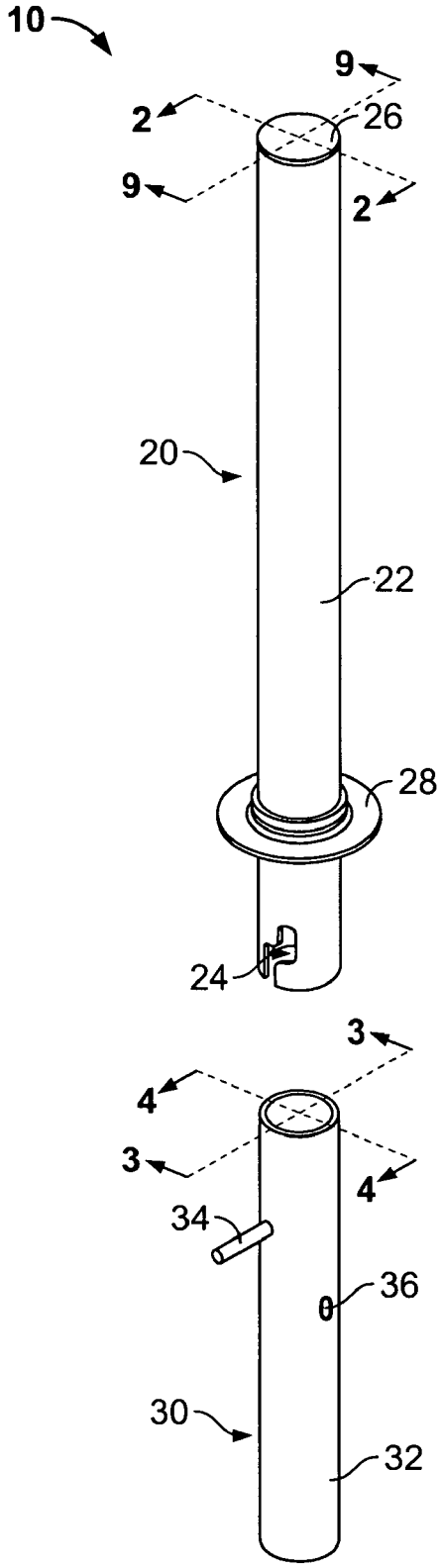
FIG. 1 is a perspective view of one example of a bollard assembly.
Figure 2:
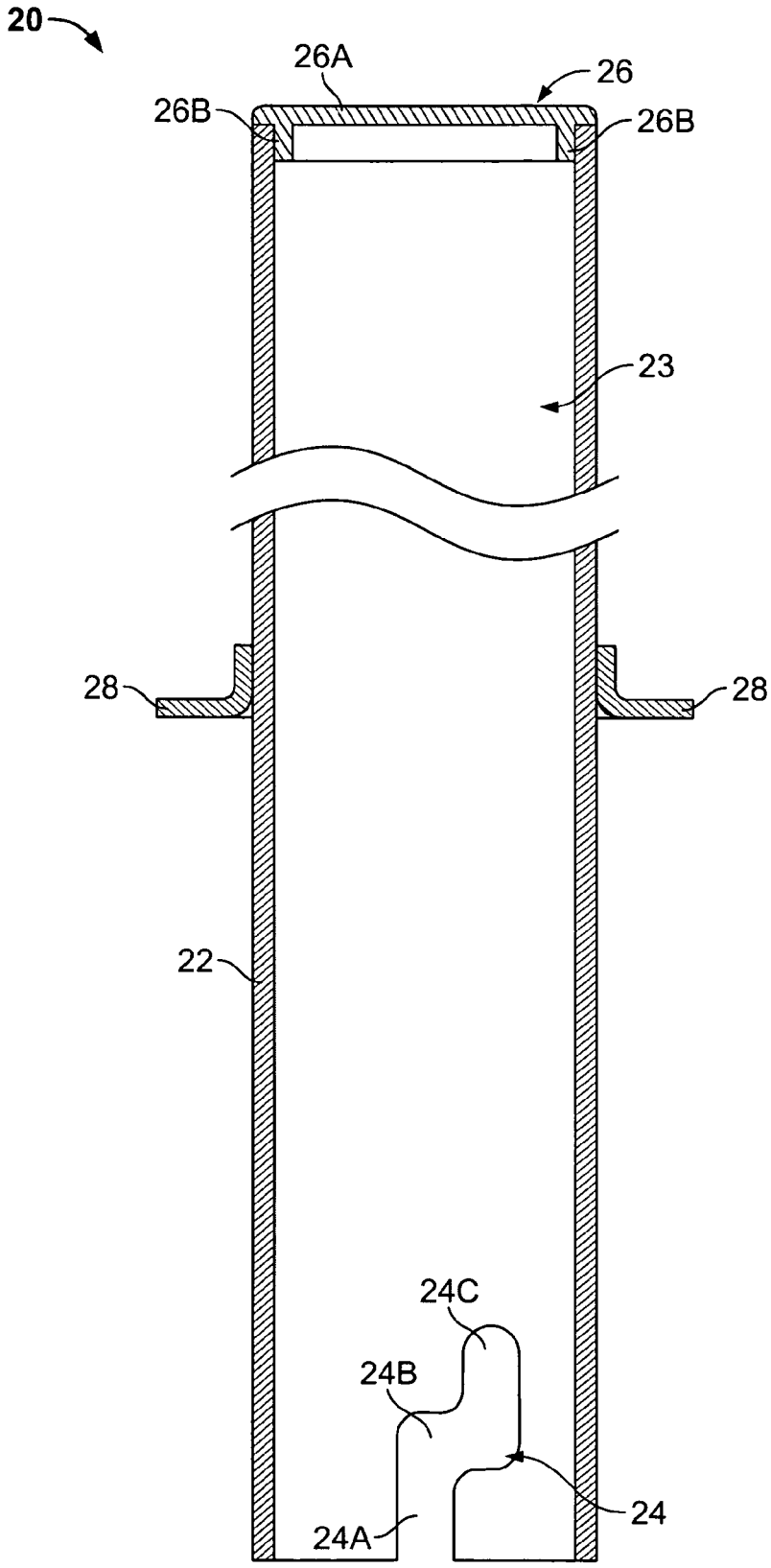
FIG. 2 is a cross-sectional view of a post of the bollard assembly taken across line 2-2 in FIG. 1.
Figure 4:
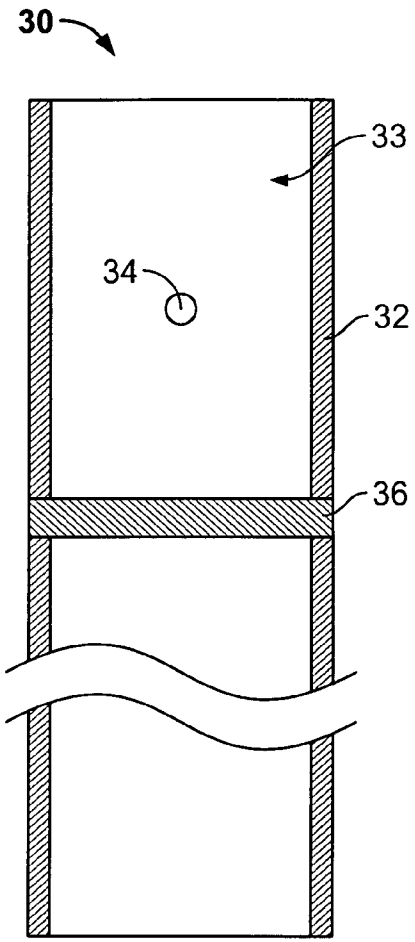
FIG. 4. is a cross-sectional view of the ground sleeve of the bollard assembly taken across line 4-4 in FIG. 1.

Referring to FIGS. 1 and 2, an exemplary bollard assembly 10 has a post 20 that has a wall 22, an end cap 26, and a flange 28. The wall 22 in this example is generally cylindrical and forms cavity 23. A passage 24 is formed in the wall 22 and is adapted to receive a latch pin 34, which is discussed in more detail below. In the example shown, the passage 24 is cut all the way through the wall 22. However, the passage 24 could also be cut only partially through the width of the wall 22 to form a channel that would receive the latch pin 34 and allow the latch pin 34 to travel through the passage 24.

The passage 24 has three sections. The first section 24A begins at one end of the wall 22 and extends longitudinally along the wall. The second section 24B begins at the end of the first section and in the example shown extends generally crosswise, preferably transverse, to the first section 24A. The third section 24C begins at the end of the second section 24B and also extends longitudinally along the wall. The stair-step type configuration of the various sections of the passage 24 prevents the post 20 from being removed from the ground sleeve 30 with a simple straight pulling motion. This gives the appearance that the post 20 cannot be removed, even in the absence of an actual locking mechanism to secure the post 20 to the ground sleeve 30.

Alternatively, the passage 24 can also be formed by two sections, the first section 24A and the second section 24B as described above. This configuration will also prevent the post 20 from being removed from the ground sleeve 30 with a simple straight pulling motion, giving the appearance that the post 20 cannot be removed.

The end cap 26 covers the end of the wall 22 opposite the passage 24. In one example, the end cap 26 has a generally circular plate 26A that has roughly the same outer diameter as the wall 22 and a flange 26B that extends from the plate 26A and is adapted to be inserted into the cavity 23. The end cap 26 is press fit into the wall 22 until the plate 26A is flush with the end of the wall 22 and the end cap 26 is secured to the wall 22 by means of LockTite® 401. Alternatively, the end cap 26 can be secured to the wall 22 by more permanent means such as welding or the end cap 26 can be integrally formed as part of the wall 22.

The flange 28 is welded to the wall 22 and prevents access to the bottom of the wall 22 when the post 20 is installed. Alternatively, the flange 28 could be formed integrally with the wall 22 or could be left off of the post 20 all together.

In one example, the post wall 22 is electric resistance welded (ERW) pipe that is made from hot dipped galvanized schedule 40 steel that has a minimum yield strength of 46,000 pounds per square inch (psi) when tested using American Society for Testing and Materials (ASTM) A500. The post wall 22 has an outer diameter of 3.5 inches, an inner diameter of 3 inches, and a length of 42.69 inches after galvanizing. In addition, in this example, the passage 24 is 0.69 inches wide, the first section 24A is 2 inches long, the second section is 1.5 inches long, the third section is 1.94 inches long, and all corners and ends of the sections have a 0.34 inch radius.

Figure 3:
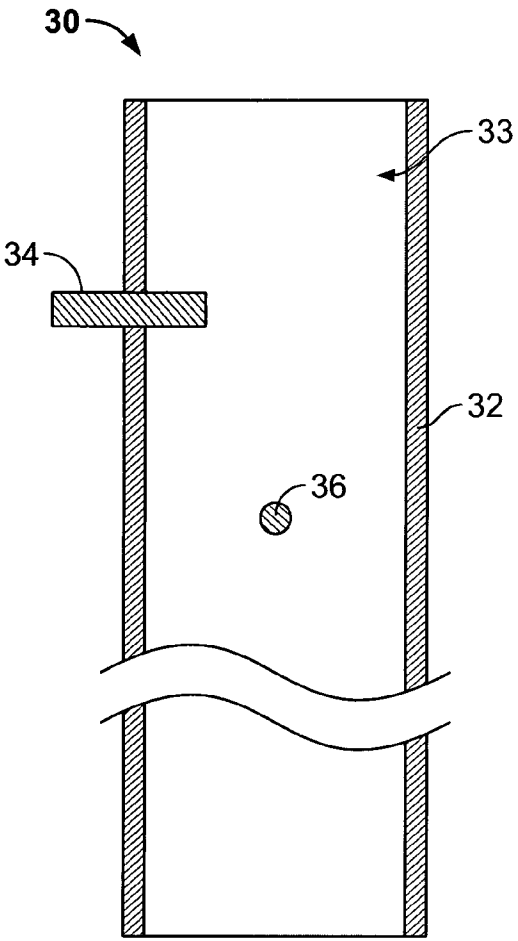
FIG. 3 is a cross-sectional view of a ground sleeve of the bollard assembly taken across line 3-3 in FIG. 1.

Referring to FIGS. 1 and 3, the bollard assembly 10 also has a ground sleeve 30 that has a wall 32, a latch pin 34, and a stop bar 36. The wall 32 is generally cylindrical, forms cavity 33, and is dimensioned to receive the post 20 into the cavity 33.

The latch pin 34 is positioned through a hole in the wall 32 and is welded in place. The latch pin 34 is positioned such that one end extends into the cavity 33 and the opposite end extends from the outside surface of the wall 22. The portion of the latch pin 34 that extends into the cavity 33 is positioned such that it will travel through the passage 24 in the post 20 when the post is inserted into the ground sleeve 30, as discussed in more detail below. The portion of the latch pin 34 that extends outside of the wall 32 prevents movement of the ground sleeve 30 when the ground sleeve is installed in the ground. Alternatively, the latch pin 34 could also be positioned such that one end extends into the cavity 33 and the opposite end is generally flush with the outer surface of the wall 32.

The stop bar 36 is positioned through a set of holes in the wall 32, which are aligned on opposite sides of the wall 32, such that the stop bar 36 extends across cavity 33 and is welded in place. The stop bar 36 will prevent the post 20 from traveling too far into the ground sleeve 30 in the event that the latch pin 34 breaks or for some other reason does not stop the travel of the post. Alternatively, the stop bar 36 could be positioned through a single hole in wall 32 and extend into cavity 33, much like the latch pin 34, or could be removed from the ground sleeve 30. Alternatively, the stop bar 36 could have a length that is greater than the outer diameter of the wall 32, thereby extending across cavity 33 and outside the outer surface of the wall 32, to prevent movements of the ground sleeve 30 when the ground sleeve is installed in the ground.

In one example, the ground sleeve wall 32 is ERW pipe that is made from hot dipped galvanized schedule 40 steel that has a minimum yield strength of 46,000 psi when tested using ASTM A500. The ground sleeve wall 32 has an outer diameter of 4 inches, an inner diameter of 3 inches, and a length of 24 inches after galvanizing. In addition, in this example, the latch pin 34 is a 0.625 inch diameter bar of 1018 steel, has a length of 2.75 inches, and is positioned such that 2 inches of the latch pin 34 extends outside of the wall 32 and the stop bar 36 is a 0.625 inch diameter bar of 1018 steel, has a length of 4 inches, and is positioned such that the ends of the stop bar 36 are generally flush with the outer surface of the wall 32.

Figure 5:
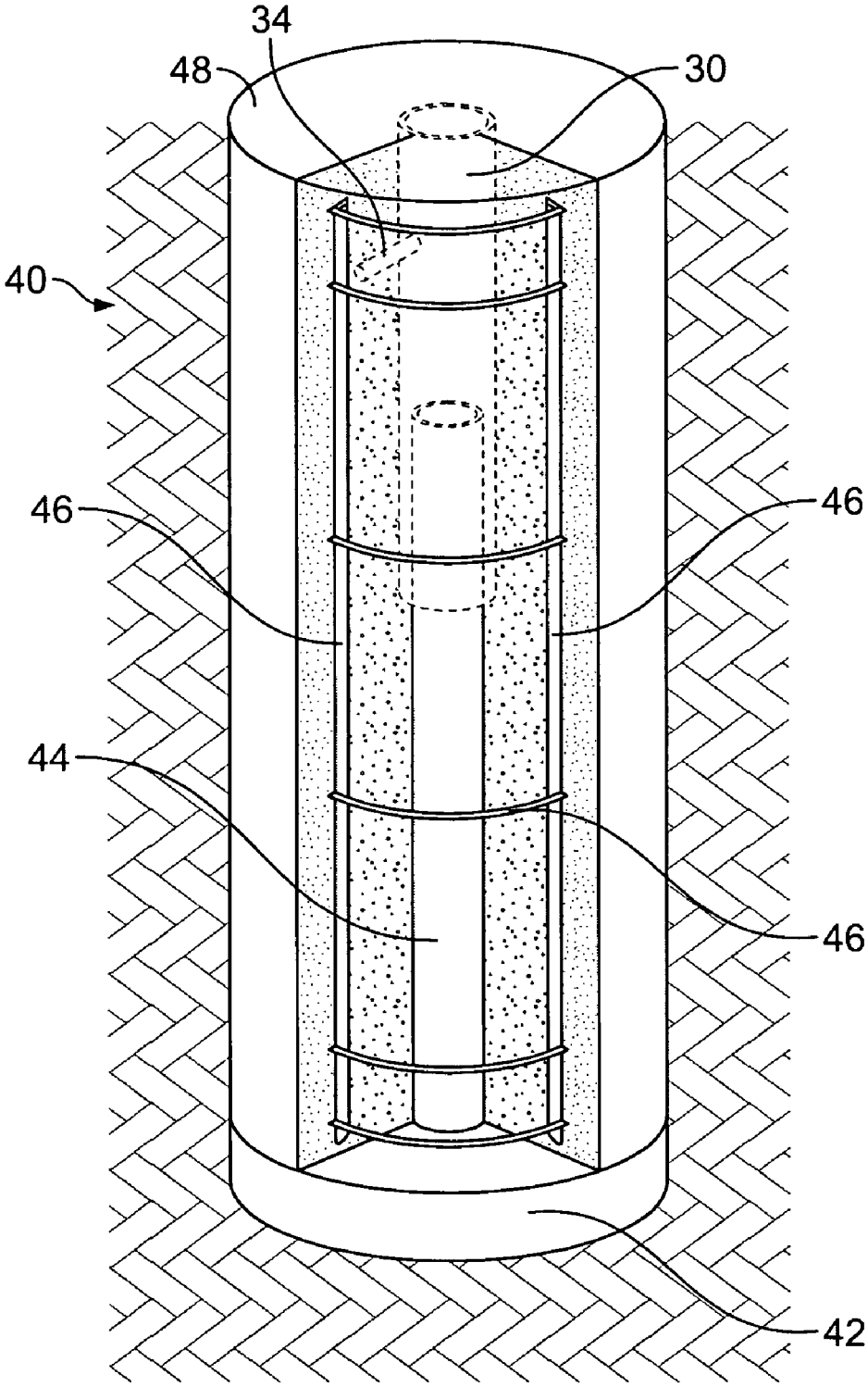
FIG. 5 is a perspective view of one example of an installation of the ground sleeve of the bollard assembly.

In operation, the ground sleeve 30 is first installed in the ground. Referring to FIG. 5, in one example a hole is dug in the ground 40 that is approximately 18 inches in diameter and 45 inches deep. The bottom of the hole is filled with approximately 3 inches of angular rock, gravel, or similar material to provide a drain base 42. A drain pipe 44, is placed in the center of the hole against the drain base 42 to provide drainage from the ground sleeve 30. In this example, the drain pipe 44 is a 2.5 inch diameter schedule 40 polyvinyl chloride (PVC) pipe that is 24 inches long. The ground sleeve 30 is placed over the drain pipe 44 such that the top of the ground sleeve 30 is level with the grade of the ground 40. If desired, rebar 46 can be placed around the drain pipe 44 and ground sleeve 30 to provide extra strength. The hole is then filled with concrete 48, such that the top of the concrete is level with the grade of the ground 40, to secure the ground sleeve 30. As mentioned above, the portion of the latch pin 34 that extends outside the ground sleeve wall will be secured in the concrete 48 and will prevent the ground sleeve 30 from rotating or moving vertically within the concrete 48.

Once the ground sleeve 30 is installed in the ground, the post 20 can be inserted into the ground sleeve 30. To insert the post 20 into the ground sleeve 30, the post 20 is positioned above the ground sleeve 30 such that the first section 24A of the passage 24 is aligned with the latch pin 34. The post 20 is then inserted into the ground sleeve 30 and pushed down so that the latch pin 34 travels along the first section 24A. Once the latch pin 34 reaches the end of the first section 24A, the post 20 is rotated so that the latch pin 34 travels along the second section 24B. Once the latch pin 34 reaches the end of the second section 24B, the post 20 is then pushed down again so that the latch pin 34 travels along the third section 24C. The post 20 is pushed down until the latch pin 34 contacts the end of the third section 24C, the bottom of the post 20 contacts the stop bar 36, or the flange 28 contacts the top of the ground sleeve 30 or the concrete 48, depending on the exact dimension and the installation of the ground sleeve 30.

Once the post 20 is fully inserted into ground sleeve 30, the flange 28 prevents access to the ground sleeve 30 and the post 20 cannot be removed by simply pulling on the post 20. Rather, the post 20 must be pulled up, rotated, and pulled further to remove it from the ground sleeve 30. This extra rotation required to remove the post 20 from the ground sleeve 30 may prevent the post 20 from being removed by unauthorized persons. Generally, if someone unfamiliar with the post 20 were to try and remove it, they would do so by pulling up on the post 20. If this were to occur, the latch pin 34 would only be allowed to travel the length of the third section 24C. Unless the person was familiar with the post 20, they would not know that the post 20 can be removed by rotating the post and would think that the post 20 was permanent.

Figure 6:
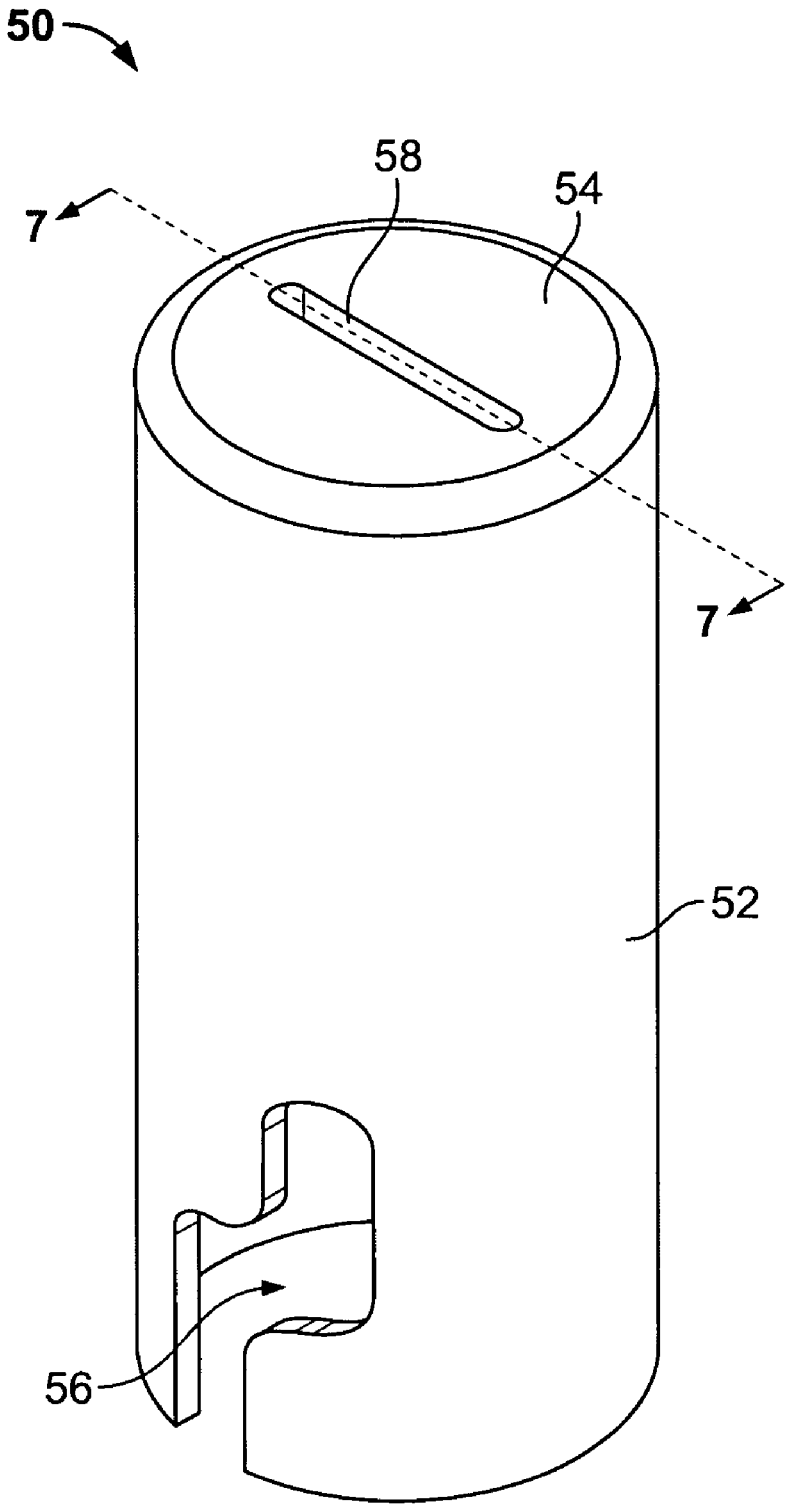
FIG. 6 is a perspective view of one example of a ground sleeve cap of the bollard assembly.
Figure 7:
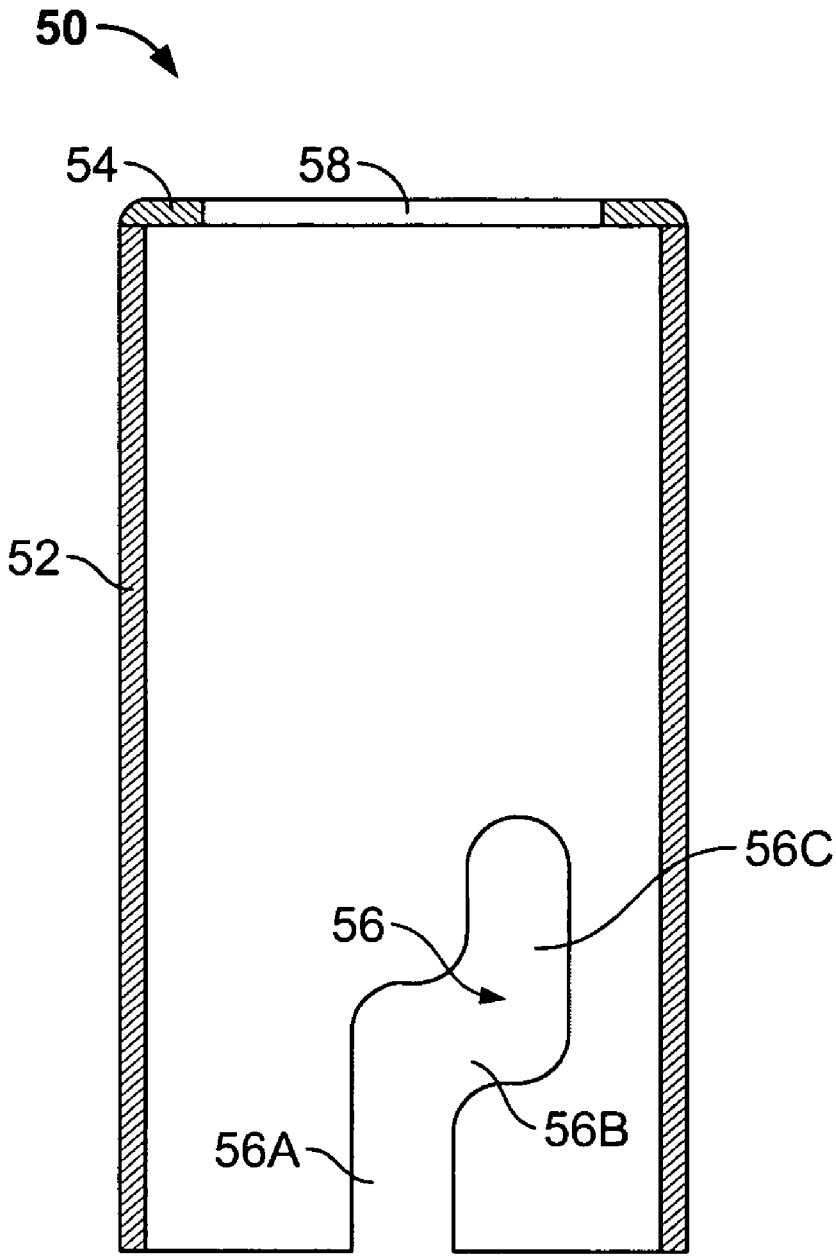
FIG. 7 is a cross-sectional view of the ground sleeve cap of the bollard assembly taken across line 7-7 in FIG. 6.

In another example, the bollard assembly 10 may also include a ground sleeve cover that would be used to cover the ground sleeve 30 when the post 20 is not installed. Referring to FIGS. 6 and 7, an exemplary ground sleeve cover 50 has a generally cylindrical wall 52 and an end cap 54. A passage 56 is formed in the wall 52, which is identical to the passage 24 in the post wall 22, and is adapted to receive the latch pin 34 in the ground sleeve 30. The passage 56 has three sections. The first section 56A begins at one end of the wall 52 and extends longitudinally along the wall. The second section 56B begins at the end of the first section and extends in this example transverse to the first section 56A. The third section 56C begins at the end of the second section 56B and also extends longitudinally along the wall. As with the post 20, the stair-step type configuration of the various sections of the passage 56 prevent the ground sleeve cover 50 from being removed from the ground sleeve 30 with a simple straight pulling motion, which gives the appearance that the ground sleeve cover 50 cannot be removed.

Alternatively, the passage 56 can also be formed by two sections, the first section 56A and the second section 56B as described above. This configuration will also prevent the ground sleeve cover 50 from being removed from the ground sleeve 30 with a simple straight pulling motion, giving the appearance that the ground sleeve cover 50 cannot be removed.

The end cap 54 covers the end of the wall 52 opposite the passage 56. The end cap 54 is placed flush with the end of the wall 52 and the end cap 54 is butt welded to the wall 52 or secured to the wall by some other well known means. Alternatively, the end cap 54 can also be integrally formed as part of the wall 52. A slot 58 is formed in the end cap 54 and is adapted to receive a key or other tool to assist in inserting and removing the ground sleeve cover 50.

In one example, the ground sleeve cover wall 52 is ERW pipe that is made from hot dipped galvanized schedule 40 steel and has a minimum yield strength of 46,000 psi when tested using ASTM A500. The ground sleeve cover wall 52 has an outer diameter of 3.5 inches, an inner diameter of 3 inches, and a length of 8 inches after galvanizing. In addition, in this example, the end cap 54 is a generally circular, hot dip galvanized, 0.25 inch thick steel plate that has roughly the same outer diameter as the wall 52 and the slot 58 extends across the end cap 54 and is 0.25 inches wide and 2.25 inches long.

To install the ground sleeve cover 50, the ground sleeve cover 50 is positioned above the ground sleeve 30 such that the first section 56A of the passage 56 is aligned with the latch pin 34. The ground sleeve cover 50 is then inserted into the ground sleeve 30 and pushed down so that the latch pin 34 travels along the first section 56A. Once the latch pin 34 reaches the end of the first section 56A, the ground sleeve cover 50 is rotated so that the latch pin 34 travels along the second section 56B. Once the latch pin 34 reaches the end of the second section 56B, the ground sleeve cover 50 is then pushed down again so that the latch pin 34 travels along the third section 56C. The ground sleeve cover 50 is pushed down until the latch pin 34 contacts the end of the third section 56C or the bottom of the ground sleeve cover 50 contacts the stop bar 36, depending on the exact dimension and the installation of the ground sleeve 30.

To remove the ground sleeve cover 50, a key or other tools is inserted into the slot 58 and the ground sleeve cover 50 is lifted so that the latch pin 34 travels along the third section 56C. The ground sleeve cover 50 is then rotated so that the latch pin 34 travels along the second section 56B and lifted again so that the latch pin 34 travels along the first section 56A and the ground sleeve cover 50 can be removed from the ground sleeve 30.

Figure 8:
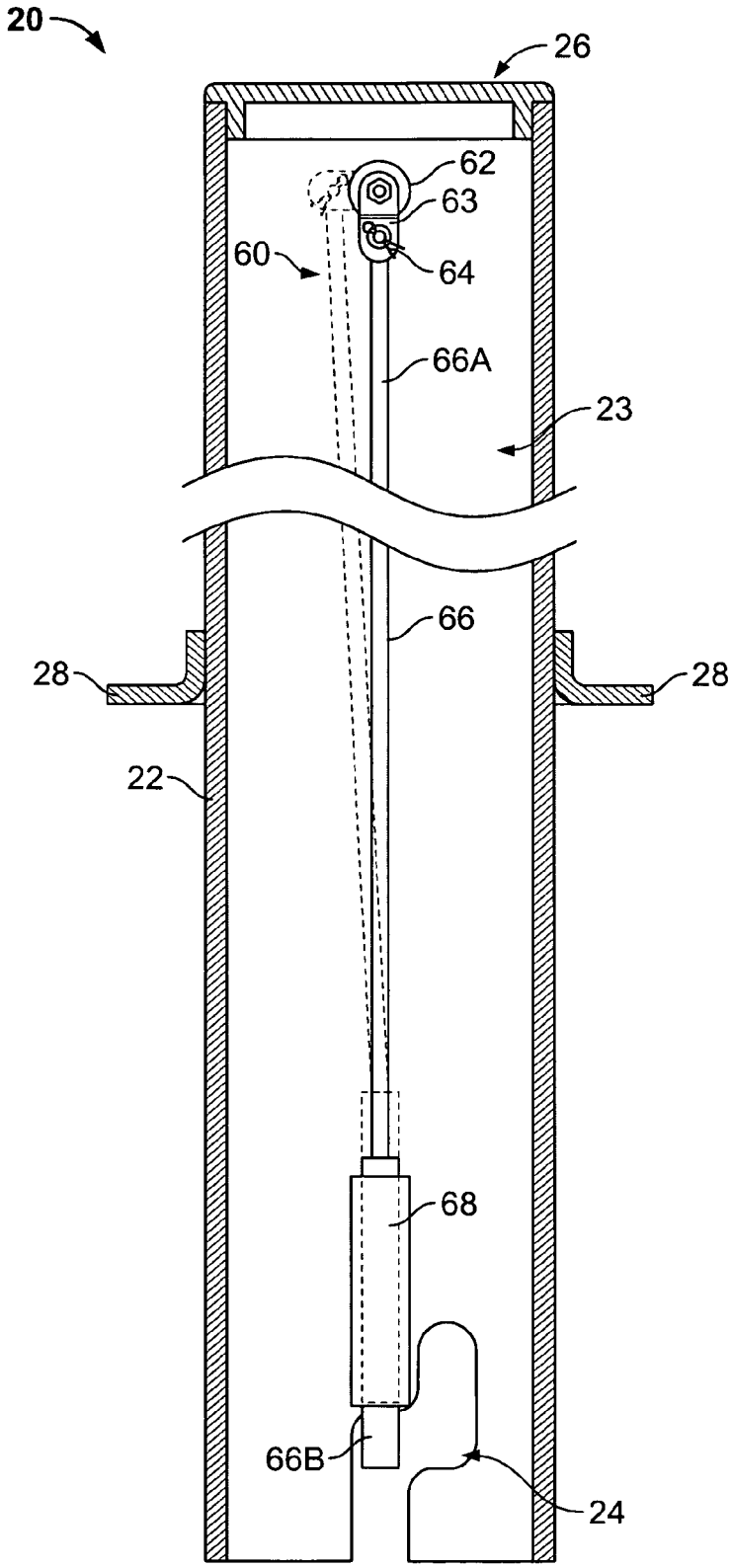
FIG. 8 is a cross-sectional view of the post of the bollard assembly taken across line 2-2 in FIG. 1 with a lock assembly.
Figure 9:
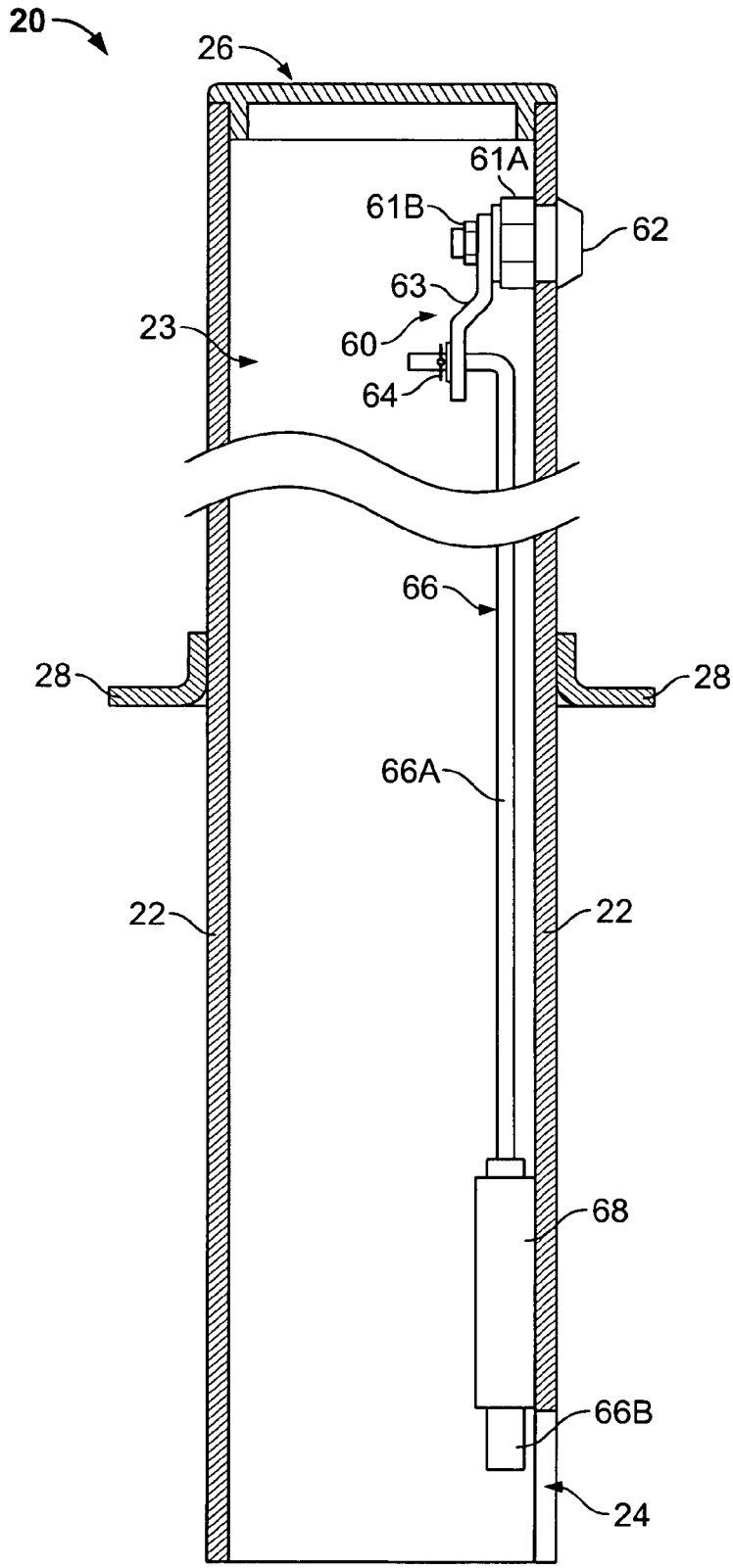
FIG. 9 is a cross-sectional view of the post of the bollard assembly taken across line 9-9 in FIG. 1 with a lock assembly.

In another example, the post 20 can also include a lock assembly to prevent removal of the post 20 from the ground sleeve 30. Referring to FIGS. 8 and 9, in one example the lock assembly 60 comprises a barrel lock 62, an arm 63, a dead bolt bar 66, and a guide 68.

The barrel lock 62 is positioned through a hole in the post wall 22 and secured in place by a nut 61A. Alternatively, the barrel lock 62 could be any suitable type of lock cylinder and could be secured to the post wall 22 in any manner desired.

The arm 63 is mounted to the back of the barrel lock 62, within the cavity 23, and is secured by nut 61B. The arm 63 is mounted to the barrel lock so that the arm 63 will rotate when the lock mechanism of the barrel lock 62 rotates. For example, as shown in FIG. 8, when the barrel lock 62 is in the locked position, the arm 63 is vertical and extends downward from the top of the post 20. When the barrel lock 62 is moved to the unlocked position, as shown in phantom in FIG. 8, the arm 63 rotates with the lock mechanism until the arm 63 is horizontal and extends transversely across the post 20.

The dead bolt bar 66 is bent at one end so that it extends through a hole in the arm and is secured to the arm by a cotter pin 64. This allows the dead bolt bar 66 to rotate within the hole in the arm 63 and move when the arm 63 is rotated. In one example, the dead bolt bar 66 has a first section 66A and a second section 66B. The first section 66A is ¼ inch diameter 1018 steel bar, ASTM 108, the second section 66B is ½ inch diameter 1018 steel bar, ASTM 108, and the two sections are welded together. The first section 66A has a smaller diameter to more easily allow it to fit in the hole in the arm 63 and the section 66B has a larger diameter to provide greater strength to prevent the latch pin 34 from traveling through the passage 24.

Lateral movement of the dead bolt bar 66 is minimized by the guide 68. The guide 68 is hollow, adapted to allow the dead bolt bar 66 to pass therethrough, and is welded to the inside surface of the post wall 22 just above the first section 24A of the passage 24. In one example, the guide 68 is a square tube, A500 grade 8, with 0.69 inch wide walls and a length of 4 inches.

In operation, the barrel lock 62 is first moved to the unlocked position (shown in phantom in FIG. 8), which rotates the arm 63 so that it is horizontal and pulls the dead bolt bar 66 upward so that the dead bolt bar 66 does not block the passage 24. The post 20 is then inserted into the ground sleeve 30 as described above. Once the post 20 has been inserted into the ground sleeve 30, the barrel lock 62 is moved to the locked position, which rotates the arm 63 so that it is vertical and pushed the dead bolt bar 66 downward so that is extends past the passage 24. As can best be seen in FIG. 8, when the barrel lock 62 is in the locked position the dead bolt bar 66 blocks passage 24 and will prevent the latch pin 34 from traveling through the passage 24, thereby preventing removal of the post 20 from the ground sleeve 30. Even if the post 20 were to be lifted so that the latch pin 34 traveled along the third section 24C of the passage 24, the post 20 could not be rotated because the dead bolt bar 66 would be blocking the passage 24.

The foregoing description of the preferred embodiment of the invention has been presented for purposes of illustration and description, and is not intended to be exhaustive or to limit the invention to the precise form disclosed. The descriptions were selected to best explain the principles of the invention and their practical application to enable other skills in the art to best utilize the invention in various embodiments and various modifications as are suited to the particular use contemplated. It is intended that the scope of the invention not be limited by the specification, but be defined by the claims set forth below.

What is claimed is:

1. A bollard assembly, comprising:

a post comprising a generally cylindrical post wall forming a cavity, the post wall having a passage comprising a first section extending generally longitudinally along the post wall and a second section intersecting the first section and extending generally crosswise to the first section;

a sleeve comprising a generally cylindrical sleeve wall forming a cavity and a latch pin attached to the sleeve wall and extending into the cavity, wherein the sleeve is adapted to receive the post such that the latch pin travels through the passage in the post wall; and a lock assembly comprising a lock cylinder secured to the post wall and extending into the post cavity and a bar connected to the lock cylinder and disposed within the cavity formed by the post wall such that the bar prevents the latch pin from traveling through the passage with the lock cylinder in a first position and allows the latch pin to travel through the passage with the lock cylinder in a second position, wherein the bar prevents the latch pin from traveling through the passage by blocking a section of the passage.

2. A bollard assembly, as recited in claim 1, wherein the second section of the passage extends generally transverse to the first section.

3. A bollard assembly, as recited in claim 1, wherein the passage further comprises a third section intersecting the second section and extending generally longitudinally along the wall.

4. A bollard assembly, as recited in claim 1, wherein the latch pin also extends through the sleeve wall and protrudes beyond an outside surface of the sleeve wall.

5. A bollard assembly, as recited in claim 1, wherein the sleeve further comprises a stop bar attached to the sleeve wall below the latch pin and extending into the cavity formed by the sleeve wall.

6. A bollard assembly, as recited in claim 1, wherein the post further comprises an end cap secured to the post wall to cover an end of the post.

7. A bollard assembly, as recited in claim 6, wherein the end cap is integral with the post wall.

8. A bollard assembly, as recited in claim 1, wherein the post further comprises a flange secured to an outside surface of the post wall and extending outward from the post wall.

9. A bollard assembly, as recited in claim 1, wherein the bar is connected to the lock cylinder via a rotatable arm.

10. A bollard assembly, as recited in claim 1, further comprising a guide secured to an interior surface of the post wall, wherein the bar travels through the guide.

11. A bollard assembly, as recited in claim 1, wherein the lock cylinder is a barrel lock.

* * * * *